US009169703B2

(12) United States Patent
Larsen et al.

(10) Patent No.: US 9,169,703 B2
(45) Date of Patent: Oct. 27, 2015

(54) ROTATABLE TUBING ANCHOR

(71) Applicant: TRIPLE D ROTATION, LLC, Gillette, WY (US)

(72) Inventors: Don Larsen, Gillette, WY (US); Duane Goetz, Gillette, WY (US); Greg Dougherty, Gillette, WY (US)

(73) Assignee: Triple D Rotation, LLC, Gillette, WY (US)

( * ) Notice: Subject to any disclaimer, the term of this patent is extended or adjusted under 35 U.S.C. 154(b) by 410 days.

(21) Appl. No.: 13/838,803

(22) Filed: Mar. 15, 2013

(65) Prior Publication Data

US 2014/0262343 A1 Sep. 18, 2014

(51) Int. Cl.

| | |
|---|---|
| ***E21B 23/00*** | (2006.01) |
| ***E21B 33/04*** | (2006.01) |
| ***E21B 33/129*** | (2006.01) |
| ***E21B 23/01*** | (2006.01) |
| ***E21B 43/12*** | (2006.01) |

(52) U.S. Cl.

CPC ..... *E21B 23/006* (2013.01); *E21B 23/01* (2013.01); *E21B 33/04* (2013.01); *E21B 33/0415* (2013.01); *E21B 33/1292* (2013.01); *E21B 33/1293* (2013.01); *E21B 43/126* (2013.01)

(58) Field of Classification Search

CPC . E21B 33/04; E21B 33/1291; E21B 33/1292; E21B 33/1293; E21B 23/006; E21B 23/01

See application file for complete search history.

(56) References Cited

U.S. PATENT DOCUMENTS

| | | | | | |
|---|---|---|---|---|---|
| 2,400,970 | A * | 5/1946 | Baker | 166/240 |
| 3,058,526 | A * | 10/1962 | Douglass et al. | 166/216 |
| 3,412,790 | A * | 11/1968 | Brown | 166/250.08 |
| 3,434,538 | A * | 3/1969 | Pumpelly et al. | 166/123 |
| 3,804,164 | A * | 4/1974 | Ellis | 166/120 |
| 4,860,826 | A | 8/1989 | Land | |
| 4,867,242 | A | 9/1989 | Hart | |
| 5,129,453 | A * | 7/1992 | Greenlee | 166/119 |
| 5,139,090 | A | 8/1992 | Land | |
| 5,327,975 | A | 7/1994 | Land | |
| 5,431,230 | A | 7/1995 | Land et al. | |
| 5,642,990 | A | 7/1997 | Short | |
| 7,909,118 | B2 | 3/2011 | Sanfelice et al. | |
| 2004/0112591 | A1 * | 6/2004 | Wright et al. | 166/217 |
| 2006/0225877 | A1 * | 10/2006 | Brookey et al. | 166/118 |
| 2013/0299200 | A1 * | 11/2013 | Hughes et al. | 166/387 |

* cited by examiner

*Primary Examiner* — Blake Michener

(74) *Attorney, Agent, or Firm* — James R. Young; Cochran Freund & Young LLC

(57) ABSTRACT

A rotatable tubing anchor for anchoring a tubing string to a casing in a well, wherein a lock pin extending radially inward from a cylindrical drag body interacts with a lazy T portion of a lock slot in a peripheral surface of a mandrel positioned in the cylindrical drag body limits vertical and rotational movement of the mandrel in relation to the cylindrical drag body in a manner that enables retaining, controlling, setting, and releasing anchor slips on the rotatable tubing anchor for lowering a tubing string equipped with the rotatable tubing anchor and a down hole pump into a well, anchoring the tubing string to casing in the well against upward tension on the tubing string while allowing rotation of the tubing string, and releasing the rotatable tubing anchor from the casing to enable pulling the tubing string, rotatable tubing anchor, and pump out of the well.

6 Claims, 14 Drawing Sheets

ROTATABLE TUBING ANCHOR

BACKGROUND OF THE INVENTION

1. Technical Field of the Invention

This invention is related to oil well production equipment and more particularly to tubing anchors in oil well production tubing strings.

2. State of the Prior Art

Typical oils wells have well casings comprising lengths of larger diameter pipes set and cemented into well bore holes extending downwardly from the surface of the ground into or through one or more subterranean, oil-bearing, geological formations called reservoirs. Conventional completions in such wells include perforating the casing with holes at depths in one or more of the reservoirs that allow the crude oil and other fluids in the reservoir or reservoirs to flow into the well casing. Some wells have enough natural pressure in the reservoir to force the crude oil and other fluids all the way through the well casing to the surface of the ground, where the crude oil can be collected and transported away from the well for further refinement and use. Other wells do not have enough natural reservoir pressure to force the crude oil all the way to the surface of the ground, so pumps have to be used to lift the crude oil in the casing out of the well. Raising and collecting the crude oil from the well is commonly known as producing the well, and equipment used in that process is commonly called production equipment. There are many different kinds of production pumps used in oil wells for pumping crude oil in well casings to the surface of the ground, one of the oldest and yet most common popular of which is the reciprocating piston-type pump, sometimes also called sucker rod pump, stroking pump, traveling piston pump, or barrel pump.

Reciprocating piston-type pumps typically have a down-hole pump assembly comprising a hollow cylinder barrel mounted on the down-hole end of a string of production tubing that extends downwardly from a hanger on the well surface, through the well casing, and into the crude oil in the well casing. A piston containing a traveling, one-way check valve is positioned the cylinder barrel in a slidable manner that allows the piston and the traveling one-way check valve to move reciprocally upwardly and downwardly in the cylinder barrel, and a standing, one-way check valve is mounted on the bottom of the cylinder barrel. A sucker rod extends downwardly from a polish rod near the surface of the ground, through the production tubing string, and into the cylinder barrel where it is attached to the piston. The polish rod extends slidably through a stuffing box to connect the sucker rod to a pump jack or other pump driver for repetitively pulling the sucker rod upwardly and letting it down to reciprocate the piston in the cylinder barrel upwardly and downwardly. The stuffing box creates a seal around the polish rod to seal the interior of the tubing from the exterior of the well. The standing one-way check valve allows fluid in the casing to flow into the cylinder barrel as the piston is pulled upwardly by the pump jack and sucker rod, and the traveling one-way check valve allows that fluid in the cylinder barrel to flow through the piston as the piston moves downwardly in the cylinder barrel. Continuous reciprocal motion of the piston in combination with the one-way flow of fluid through the standing and traveling check valves results in the fluid in the well being pumped from the casing upwardly through the production tubing string to the surface of the well.

As explained in U.S. Pat. Nos. 5,139,090 and 5,327,975 issued to J. Land, both of which are incorporated herein for all that they disclose, in wells equipped with reciprocating piston-type pumps, rotating the production tubing string with respect to the sucker rod in the tubing string while concurrently placing the production tubing string in tension reduces severity of wear in areas where the sucker rod tends to rub against the inside surface of the tubing string and overall increases the useful life of the tubing string. Both of the aforesaid U.S. Pat. Nos. 5,139,090 and 5,327,975 describe apparatus and methods for anchoring the tubing string at or near the bottom of the well adjacent to the cylinder barrel in a rotatable manner to accommodate such tensioning and rotation of the production tubing string. The tubing anchor catcher with rotatable mandrel is described in the U.S. Pat. No. 5,327,975 as an improvement over the tubing rotator with down hole swivel described in U.S. Pat. No. 5,139,090. However, it has been found that tubing anchor catchers with rotatable mandrels made as described in the U.S. Pat. No. 5,327,975 are not reliably easy to set and are even more difficult to release and retrieve from the well, which results in problems when the tubing string, down hole pump components, and other production equipment in the well have to be removed from the well. Too often, inability to release those tubing anchor catchers quickly and easily is frustrating and time-consuming, sometimes causing the operator to resort to the back-up system of pulling hard on the tubing string to shear the shear pins in the anchor to release the slips that anchor the device in the well casing. Unfortunately, however, some tubing strings are in severely worn or in weakened condition, and such extraordinary tension breaks and severs the tubing string before the shear pins of the anchor shear, thereby causing the operator have to perform extraordinary recovery procedures, including, for example, drilling and fishing the remaining tubing and the tubing anchor catcher out of the well. Such extraordinary procedures not only add to the recovery time and costs but also destroy the tubing anchor catchers so that they cannot be used again.

The foregoing examples of related art and limitations related therewith are intended to be illustrative, but not exclusive or exhaustive, of the subject matter. Other aspects and limitations of the related art will become apparent to those skilled in the art upon a reading of the specification and a study of the drawings.

BRIEF DESCRIPTION OF THE DRAWINGS

The accompanying drawings, which are incorporated herein and form a part of the specification, illustrate some, but not the only or exclusive, example embodiments and/or features. It is intended that the embodiments and figures disclosed herein are to be considered illustrative rather than limiting.

In the drawings.

DETAILED DESCRIPTION OF EXAMPLE EMBODIMENT

Figure 1:
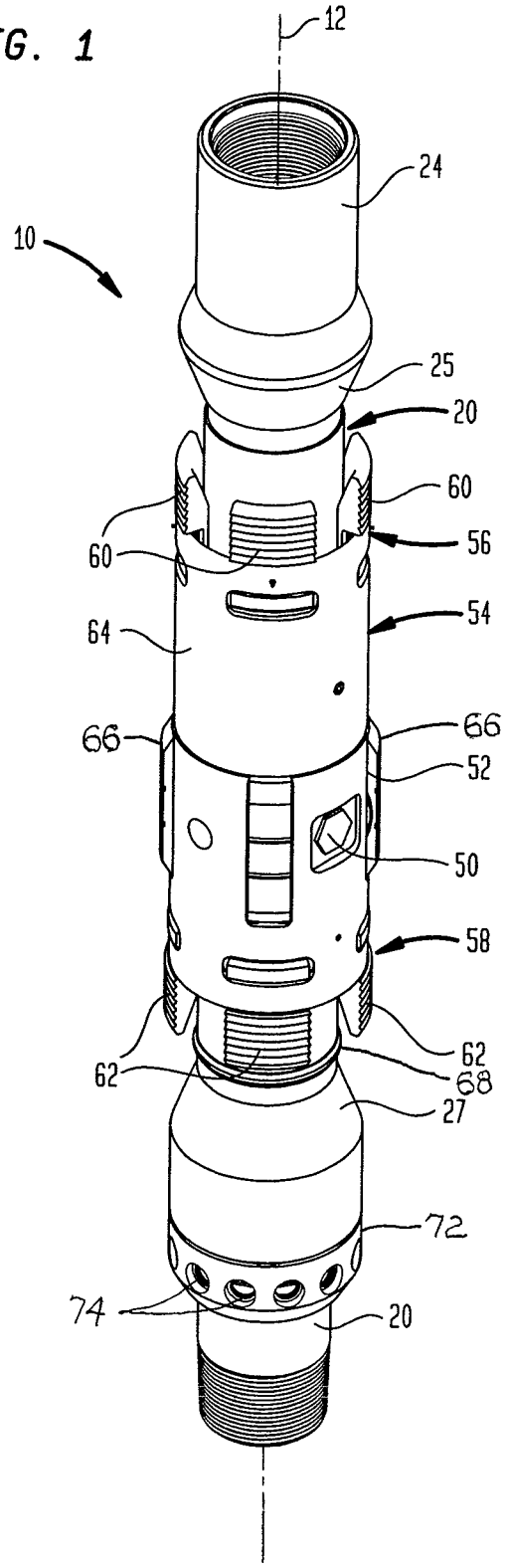
FIG. 1 is a perspective view of an example embodiment of a rotatable tubing anchor.

An example rotatable tubing anchor 10 is shown in FIG. 1 as a diagrammatic illustration of one example embodiment and implementation of the invention, but recognizing that the invention recited in the claims below can also be implemented in myriad other ways and in myriad other apparatus once the principles are understood from the description herein. The example rotatable tubing anchor embodiment 10 includes a rotatable mandrel 20 extending through a cylindrical drag body 52, which is part of an anchor assembly 54. The mandrel 20 has a lock slot 30 (best seen in FIG. 2) that is milled or otherwise formed in the peripheral surface of the rotatable mandrel 20 for limiting axial and rotational movement of the mandrel 20 in relation to the drag body 52 and other components of the anchor assembly 54. Additional description of the operative component parts of the example rotatable tubing anchor 10 are described below, but initial focus in this description is directed to the configuration of the lock slot 30 in the mandrel 20, because the functions of the mandrel 20, anchor assembly 54, and other operative components are best understood in relation to the lock slot 30. Suffice it to say at this point that rotation of the mandrel 20 in relation to the drag body 52 is very limited or even prohibited when the inner end 51 of the lock pin 50 (FIGS. 1, 5, and 6), which extends radially inward from the cylindrical drag body 52 of an anchor assembly 54 (see FIGS. 5 and 6), is positioned in the lock slot 30 (FIG. 2), as will be explained in more detail below. Some limited vertical movement of the mandrel 20 along the longitudinal axis 12 is allowed by the lock pin 50 while the drag body 52 is stationary in the well casing 50, as will be explained below, and the mandrel 20 is fully rotational 360 degrees in relation to the drag body 52 when the circumferential groove 22 around the peripheral surface of the mandrel 20 (FIG. 2) is aligned with the inner end 51 of the lock pin 50.

Figure 2:
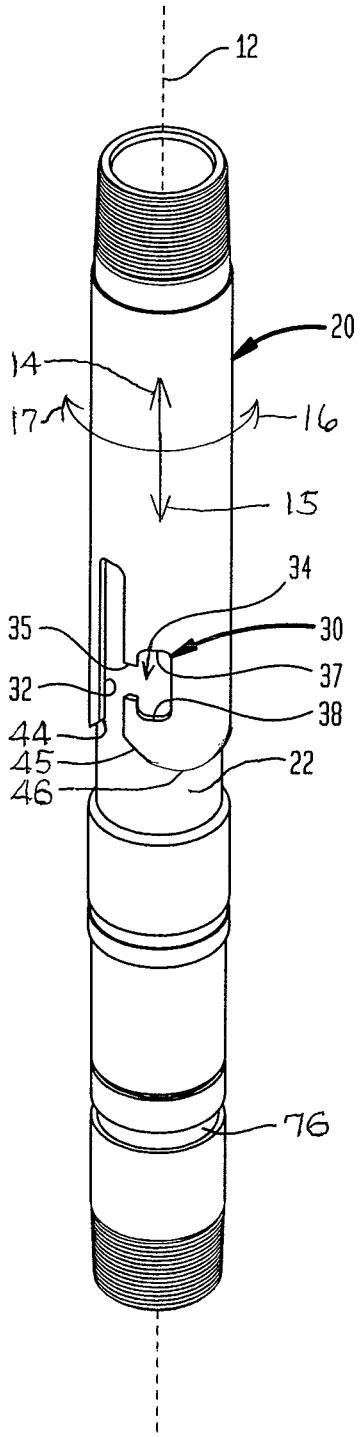
FIG. 2 is a perspective view of the rotatable mandrel of the example rotatable tubing anchor in FIG. 1.
Figure 3:
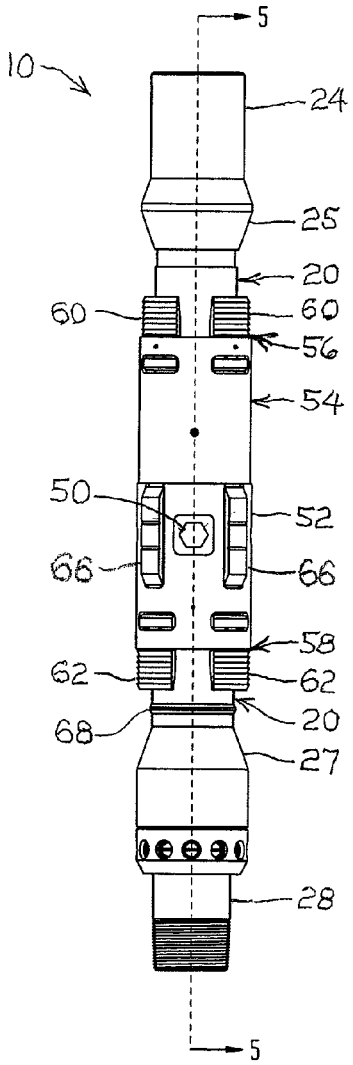
FIG. 3 is an elevation view of one side of the example rotatable tubing anchor in FIG. 1.
Figure 4:
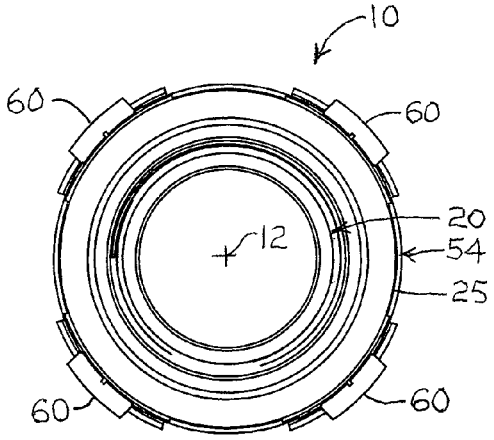
FIG. 4 is a top plan view of the example rotatable tubing anchor in FIG. 1.

Therefore, with reference now primarily to FIG. 2, the lock slot 30 in the mandrel 20 includes a vertical entrance portion 32 that extends vertically from the circumferential groove 22 substantially parallel to the longitudinal axis 12 of the mandrel 20. The lock slot 30 also has a "lazy T" portion 34, i.e., a portion 34 of the lock slot 30 that resembles a letter T lying on its side similar to a "lazy T" livestock brand. Therefore, that portion 34 of the lock slot 30 with the shape that resembles a lazy T livestock brand is sometimes referred to in this description as the lazy T portion 34. The horizontal stem 35 of the lazy T in the lazy T portion 34 extends from the vertical entrance portion 32 to the cross-bar 36 of the lazy T in the lazy T portion 34. Therefore, the cross-bar 36 of the lazy T portion 34 is also oriented vertically and substantially parallel to the longitudinal axis 12. The upper extremity or edge 37 of the cross-bar 36 aligns with, and bears on, the lock pin 50 (FIGS. 1, 3, 5, and 6) when the tubing string T, the rotating tubing anchor 10, and the pump P are being lowered into the well casing C, as will be explained in more detail below. The lower extremity or edge 38 of the cross-bar 36 aligns with, and bears on, the lock pin 50 when the tubing string T, the rotatable tubing anchor 10, and the pump P are being pulled out of the well, as will also be explained in more detail below.

Figure 7:
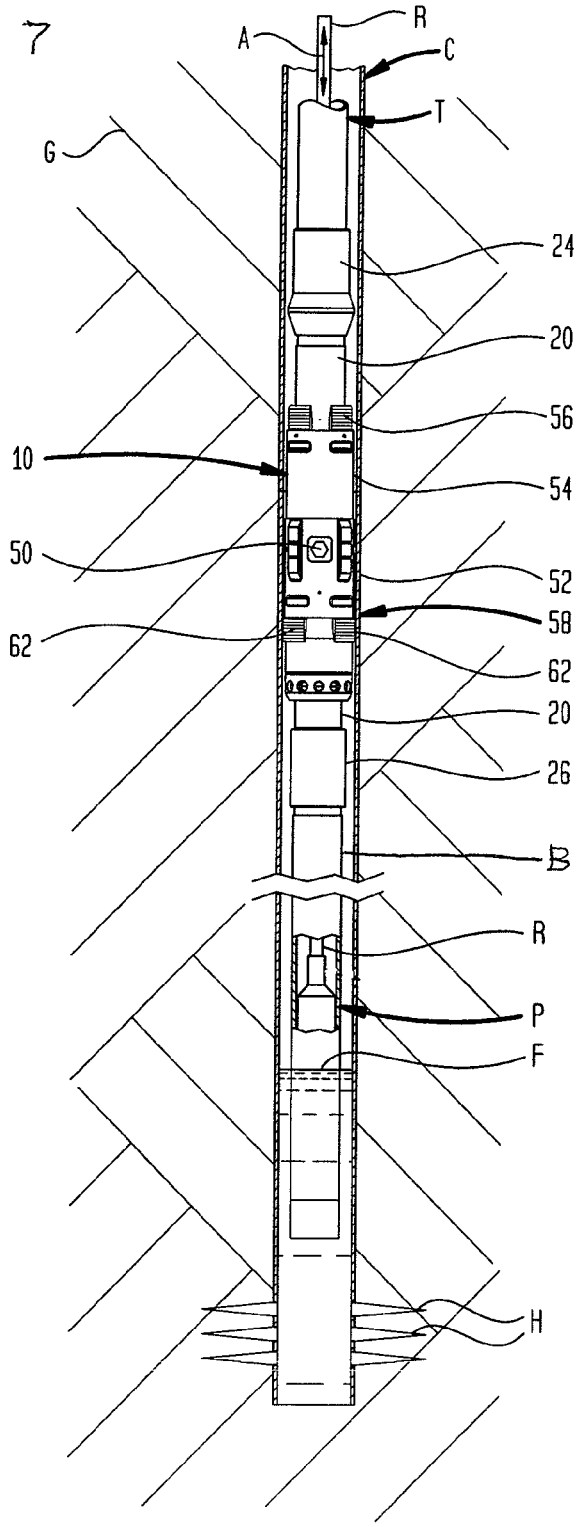
FIG. 7 is an elevation view of the example rotatable tubing anchor of FIG. 1 shown mounted in a production tubing string along with a down hole pump and anchored in a typical well casing.

Referring now primarily to FIGS. 1 and 7 together, the example rotatable tubing anchor 10 is typically mounted near the bottom of a production tubing string T, just above a down-hole pump, such as the reciprocating piston-type pump P depicted diagrammatically in FIG. 7. As illustrated, for example, in FIG. 7, the tubing string T, the example rotatable tubing anchor 10, and the down-hole pump P are positioned in the casing C of a well that is drilled into a geological formation G that bears oil, gas, water, or other fluid that is to be produced to the surface of the ground. Reciprocating piston-type pumps are typically mounted in a section of tubing at or near the bottom end of the production tubing string T. Accordingly, the pump P is shown in FIG. 7 mounted in a bottom tubing section. The example rotatable tubing anchor 10 is shown in FIG. 7 as connected between the bottom tubing section B and the rest of the tubing string T, although it could be in a different position, and other production equipment or appurtenances could also be included. Perforation holes H, which extend through the casing C and into the formation G, allow oil and other fluids F to flow from the formation F into the casing C. The production tubing string T is made long enough to position the pump P in the fluid F in the casing C. A sucker rod R extends downwardly from a polish rod (not shown) near the surface of the ground G, through the production tubing string T, to the pump P, where it is attached to a piston (not shown) in the pump P. The sucker rod R is reciprocated up and down, as indicated by arrow A, by a pump actuator (not shown) on the surface of the ground G to reciprocate the piston in the down hole pump P. The reciprocating piston in combination with standing and traveling check valves (not shown) in the pump P, pumps the fluid F through the production tubing T to the surface of the ground G.

The rotatable tubing anchor 10 is used to anchor the lower end of the production tubing string T to a particular location in the casing C. After the rotatable tubing anchor is set in immovable relation to the casing C, the production tubing string T is pulled upwardly against the rotatable tubing anchor 10 to place the tubing string T in tension, and the upper end of the tubing string T is then fastened at the well head (not shown) in such tension. A rotation drive mechanism (not shown) connected to the tubing string T at the well head slowly rotates the production tubing string T as the well is pumped. Such rotation of the tubing string T while the well is pumped extends the useful life of the tubing string T by eliminating spot wear in particular tubing sections that may be caused by the sucker rod R rubbing on localized spots on the inside surface of the production tubing string T, for example, where there is a bend or deviation in the tubing string T. The rotation of the tubing string T spreads such wear over larger areas around the inside surface of the tubing string T instead of allowing all of the wear to be concentrated in one spot. The rotating tubing anchor 10 accommodates such rotation of the tubing string T while anchoring the lower end of the tubing string T to the casing C in a manner that resists the upward pull on the production tubing string T, thereby holding the production tubing string T in tension as described above, which also reduces wear by minimizing bends and deviations where such rubbing of the sucker rod R on the tubing string T tends to occur.

Figure 5:
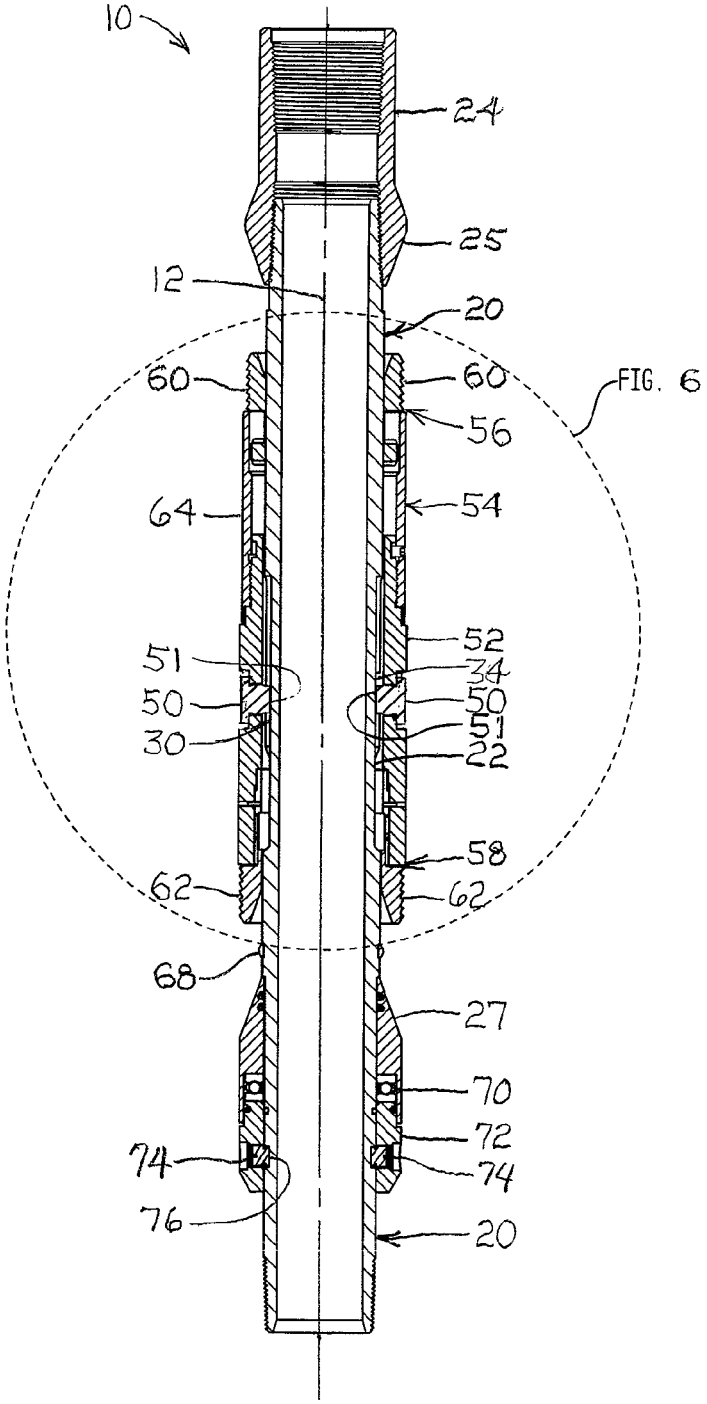
FIG. 5 is cross-section view of the example rotatable tubing anchor taken along section line 5-5 in FIG. 3.

With continuing reference to FIGS. 1, 5, and 7, the rotatable mandrel 20 of the example rotatable tubing anchor 10 is positioned inside the cylindrical drag body 52 of the anchor assembly 54 in a manner that allows limited up, down, and rotatable movement of the mandrel 20 in relation to the drag body 52 and other components of the anchor assembly 54, as will be described in more detail below. A pipe coupler 24 can be used to connect the upper end of the mandrel 20 to the tubing string T, and a lower pipe coupler 26 can be used to connect the lower end of the mandrel 20 to the bottom tubing section B, as shown in FIGS. 5 and 7, although those connections can be made with other pipe components or in other ways as would be understood by persons skilled in the art. Therefore, the mandrel 20 moves down and up along the longitudinal axis 12 as the production tubing string T moves down and up in the casing C, and the mandrel 20 rotates right or left (clockwise or counterclockwise) as the production tubing string T rotates right or left (clockwise or counterclockwise). For convenience in this description, directional adjectives, adverbs, prepositions, and other directional indicators are used in relation to the orientations of the drawing views on the paper, not necessarily as the rotatable tubing anchor 10 would be oriented or positioned in any particular well. Therefore, directional words such as up, down, upper, lower, right, left, over, above, under, below, vertical, horizontal, and others in this description refer to the orientations of the views in the drawings and are not meant to limit the actual orientation in which the apparatus may be positioned or oriented in actual use. For example, in actual use, it is possible that the rotatable tubing anchor 10 may be disposed with its longitudinal axis 12 oriented vertically in a vertical well bore that extends straight down from the surface of the ground, but it could also be disposed with the longitudinal axis 12 in a slanted or even horizontal orientation in wells drilled directionally in various orientations and directions as would be understood by persons skilled in the art. For clarity in this description, referring to FIG. 2, movement of the mandrel 20 up or upwardly means in the direction indicated by the arrow 14; movement of the mandrel 20 down or downwardly means in the direction indicated by the arrow 15; rotation of the mandrel 20 counterclockwise or to the right means in the angular direction indicated by the arrow 16; and rotation of the mandrel 20 clockwise or to the left means in the angular direction indicated by the arrow 17.

Referring again to FIGS. 1, 5, and 6, the anchor assembly 54 of the rotatable tubing anchor 10 comprises the cylindrical drag body 52 through which the mandrel 20 extends, an upper slip assembly 56, and a lower slip assembly 58. The lower slip assembly 58 comprises a plurality of lower slips 62 mounted in the drag body 52, and the upper slip assembly 56 comprises a plurality of upper slips 60 mounted in a cylindrical slip cage 64, which is attached to, and extends upwardly from, the drag body 52. The lower slips 62 anchor the rotatable tubing anchor 10 to the inside surface of the casing C when the lower slips 62 are set, as will be described in more detail below. However, persons skilled in the art are familiar with the structures and functions of slips in oil well equipment and probably do not need further explanations of slips or of the operation of slips. Also, persons skilled in the art will recognize that slips can be provided with other components, structures and assemblies for use in this invention once they understand the principles of the invention.

Figure 6:
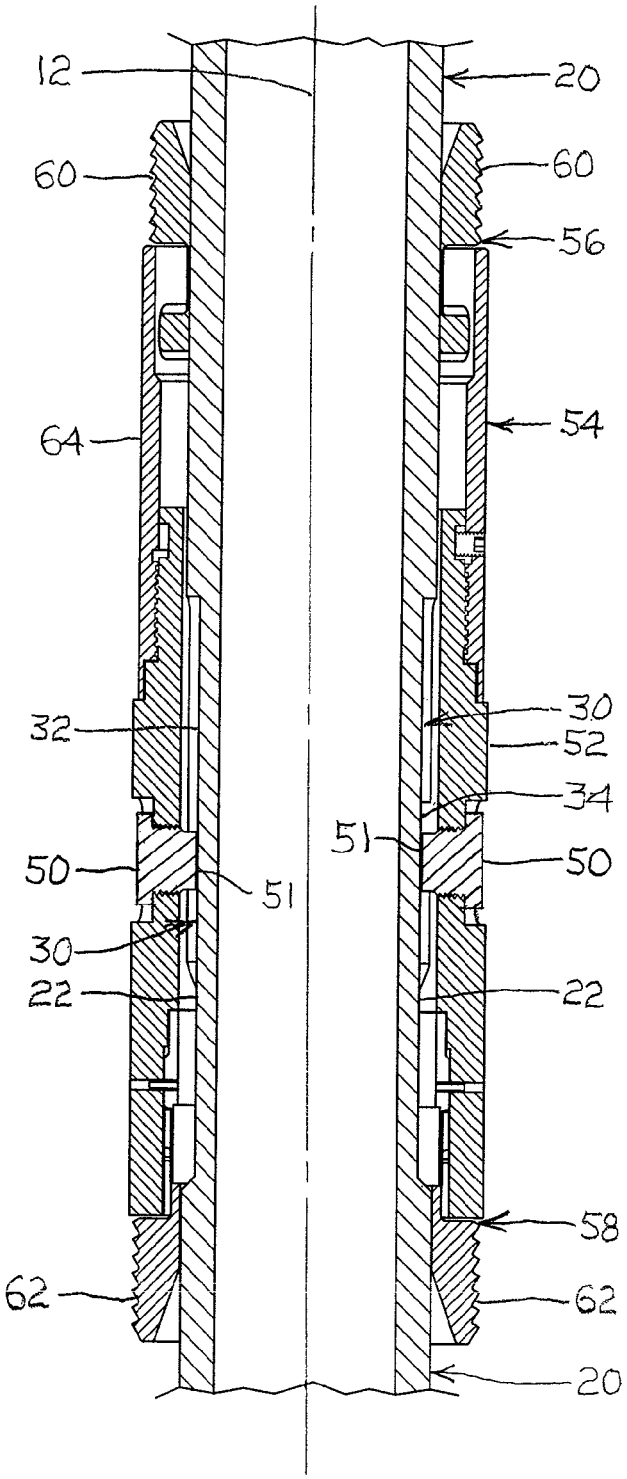
FIG. 6 is an enlarged view of the portion of the cross-sectional view of FIG. 5 that is circled in FIG. 5.
Figure 10:
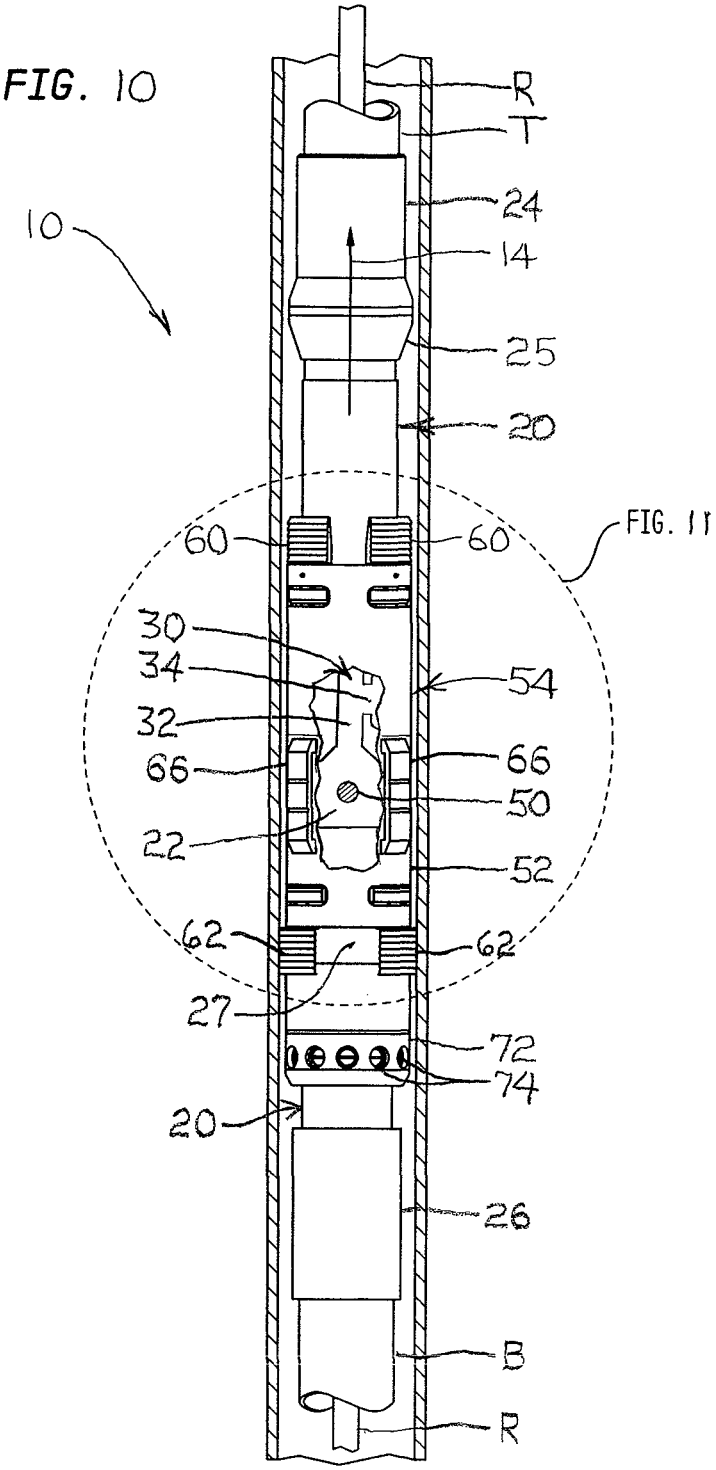
FIG. 10 is an elevation view of the example rotatable tubing anchor similar to FIG. 8, but with the mandrel in a mode that sets the lower slips to anchor the rotatable tubing anchor and lower portion of the tubing string to the casing and wherein the mandrel of the rotatable tubing anchor is unlocked and freely rotatable in relation to the drag body and other anchor assembly components of the rotatable tubing anchor.
Figure 11:
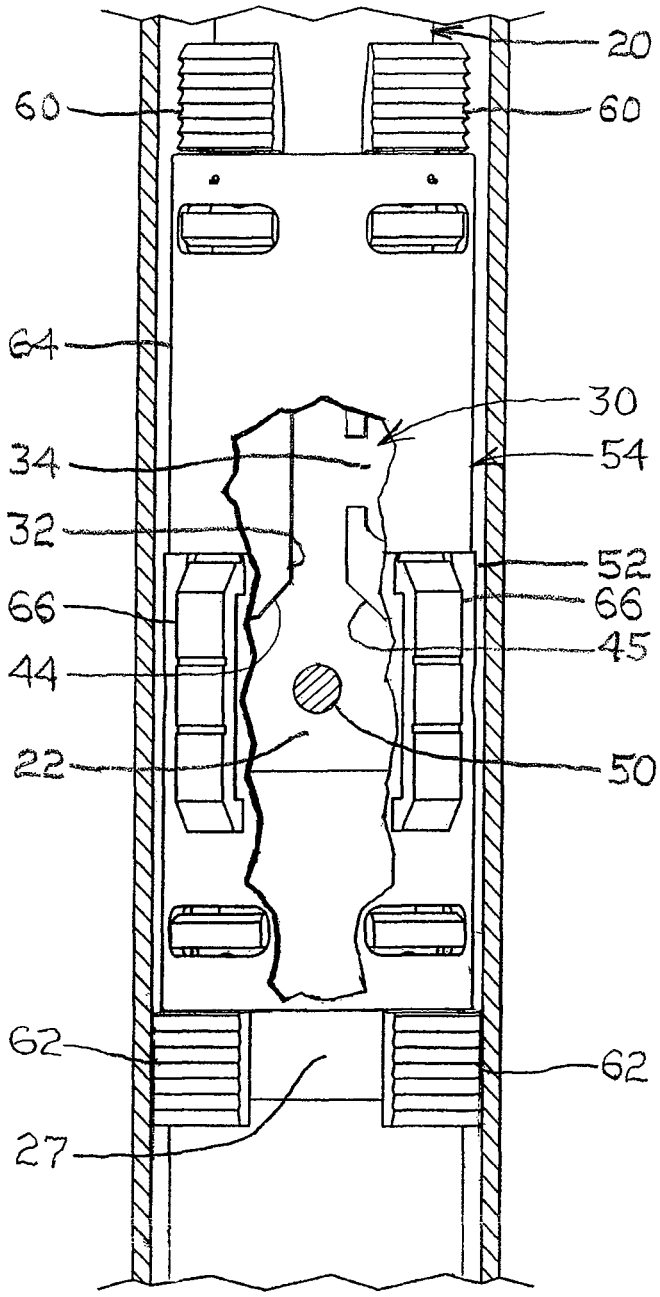
FIG. 11 is an enlarged view of the portion of the elevation view of FIG. 10 that is circled in FIG. 10.

Essentially, in the example rotatable tubing anchor 10, a lower cone 27 mounted on the mandrel 20 adjacent to the lower end 28 of the mandrel 20 is sized and shaped to wedge under the lower slips 62 between the slips 62 and the mandrel 20 when the mandrel 20 is pulled upwardly in relation to the drag body 52, as best seen in FIGS. 10 and 11, which will be described in more detail below. Such wedging of the lower cone 27 on the lower slips 62 forces the lower slips 62 radially outward into engagement with the inside surface of the casing C, as illustrated in FIGS. 6, 10, and 11. When the lower slips 62 are engaged with the inside surface of the casing C in this manner, the anchor assembly 54 can resist a large, upwardly directed, pulling force on the production tubing string T and mandrel 20, thus effectively anchoring the lower end of the production tubing string T in that position. To release the rotatable tubing anchor 10 from such anchored engagement with the casing C, therefore, the mandrel 20 with the lower cone 27 have to be moved downward in relation to the lower slips 62 and cylindrical drag body 54 so that the lower slips 62 can move radially inward to disengage from the inside surface of the casing C.

Figure 14:
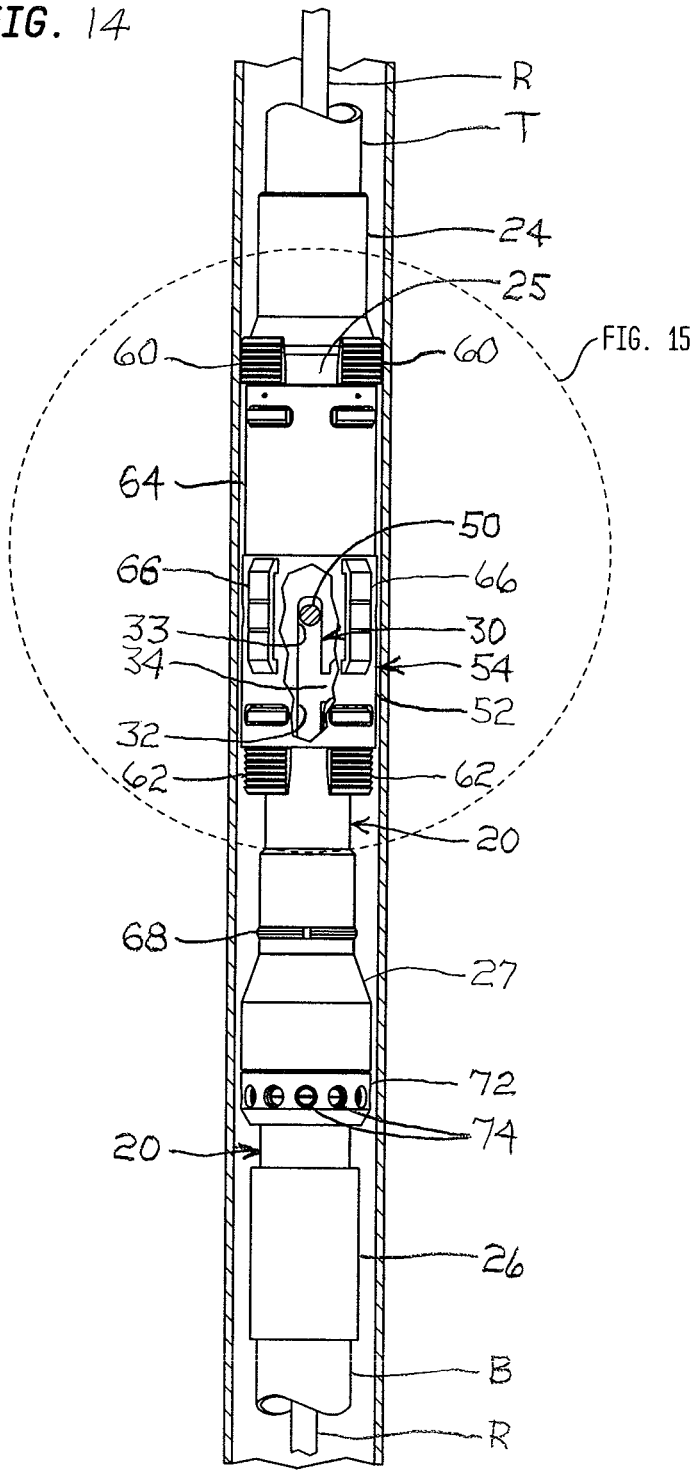
FIG. 14 is an elevation view of the example rotatable tubing anchor similar to FIGS. 8, 10, and 12, but with the mandrel in a mode that sets the upper slips to anchor the rotatable tubing anchor and lower portion of the tubing string to the casing and where in the mandrel of the rotatable tubing anchor is locked against rotation in relation to the drag body and other anchor assembly components.
Figure 15:
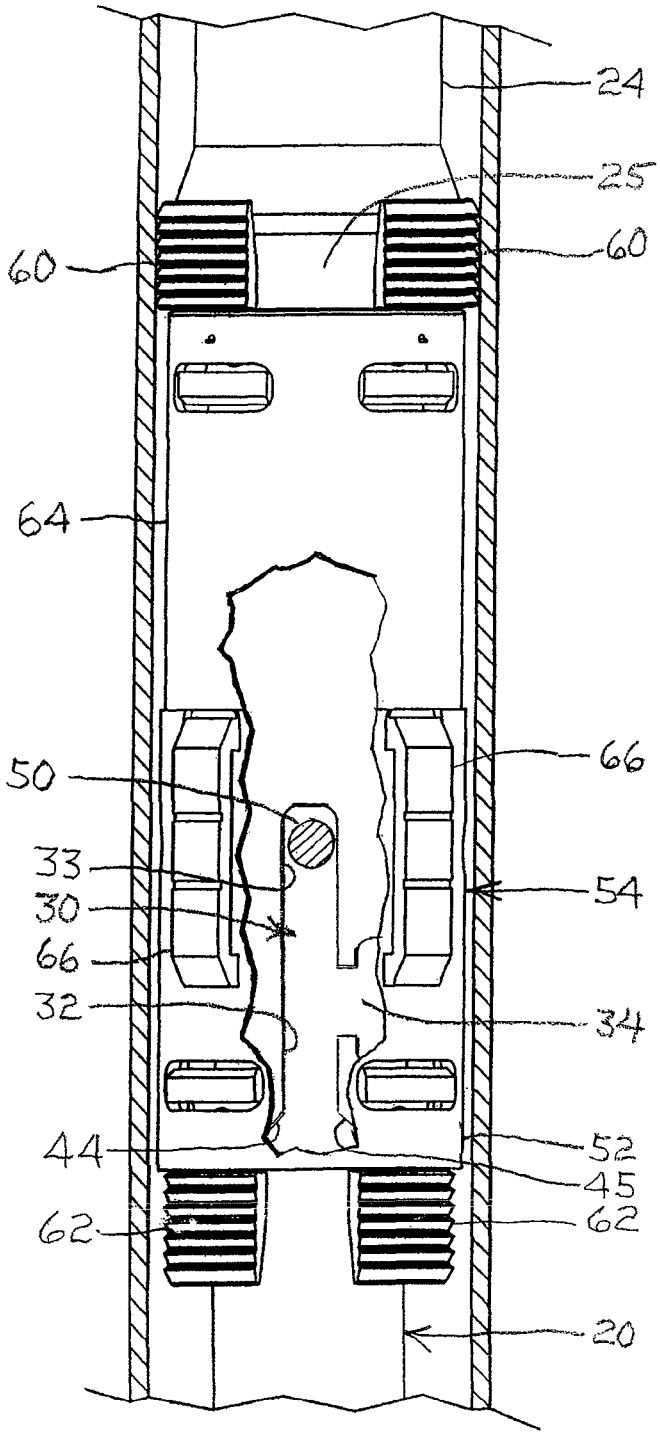
FIG. 15 is an enlarged view of the portion of the elevation view of FIG. 14 that is circled in FIG. 14.

The upper slips 60 anchor the rotatable tubing anchor 10 to the inside surface of the casing C when the upper slips 60 are set. Setting the upper slips 60 is accomplished in a similar manner to setting the lower slips 62, but opposite in direction. Essentially, the upper slips 60 can be set into engagement with the inside surface of the casing C to anchor the rotatable tubing anchor 10 in a fixed position in the casing C by moving the production tubing string T and mandrel 20 downwardly far enough in relation to the drag body 52 and slip cage 64 to force the upper cone 25 on the upper coupler 24 to wedge between the upper slips 60 and the mandrel 20, thereby forcing the upper slips 60 radially outward into engagement with the inside surface of the casing C, as best seen in FIGS. 14 and 15. When the upper slips 60 are set into engagement with the casing C in that manner, the rotatable tubing anchor 10 can resist a large, downwardly directed, force on the mandrel 20, thereby anchoring the rotatable tubing anchor 10 and production tubing string T from moving farther down the well. To release the upper slip assembly 56, the production tubing string T and mandrel 20 with the upper cone 25 have to be moved upwardly in relation to the upper slip assembly 56 to allow the upper slips 60 to move radially inward, away from the inside surface of the casing C, as illustrated in FIGS. 8 and 9.

While the slips 60 or 62 are capable of anchoring the tubing string T very securely to the casing C when set, as explained above, it is important to prevent both the upper slips 60 and lower slips 62 from engaging the casing C as the production tubing string T, rotatable tubing anchor 10, and pump P are being lowered into the well as well as when they are being pulled back out of the well. The lock slot 30 shown in FIG. 2, interacting with the lock pin 50 shown in FIGS. 1, 3, 5, and 6, not only provides the function of preventing the upper slips 60 and lower slips 62 from being set while lowering the tubing string T, rotatable tubing anchor, and pump P into the well and while pulling them out of the well, but also enables the mandrel 20 to be manipulated into a position in relation to the drag body 52 in which the mandrel 20 is freely rotatable in relation to the drag body 52 when the lower slips 62 are set in anchored relation to the casing C.

Figure 8:
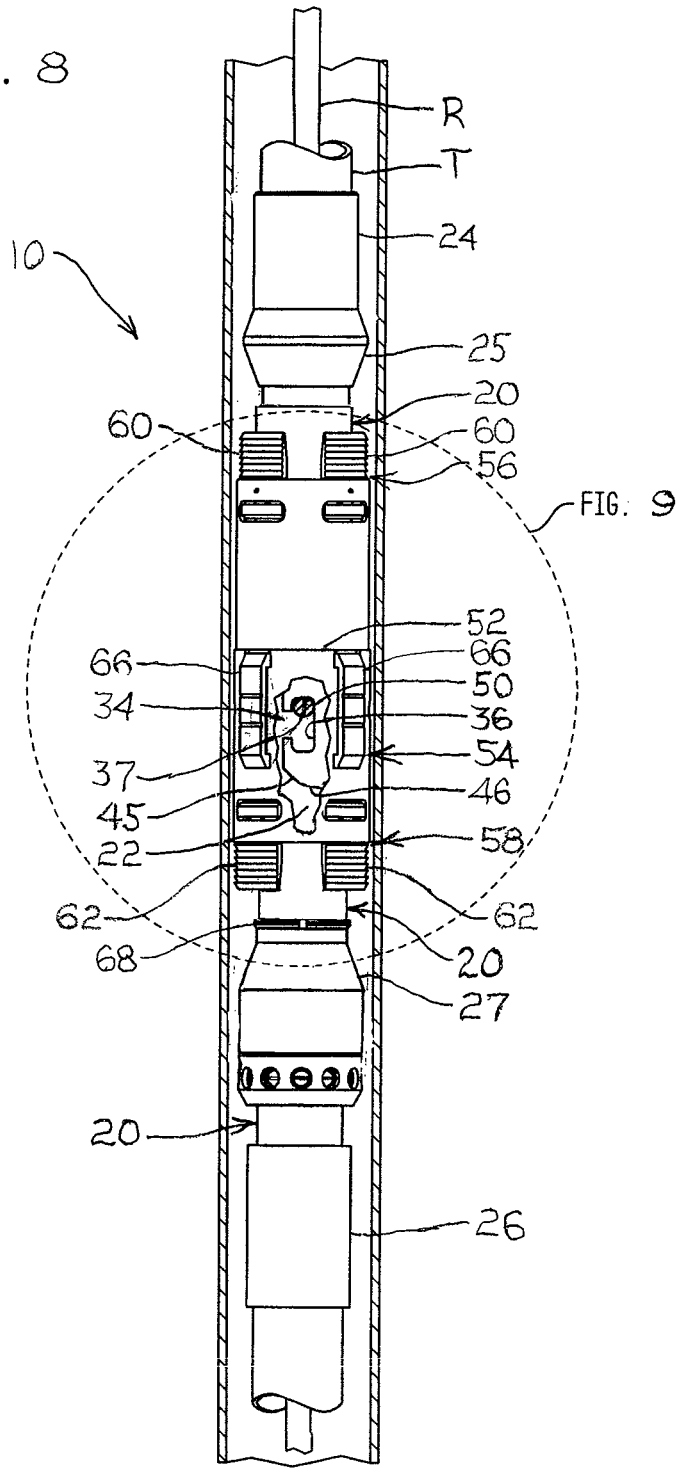
FIG. 8 is an elevation view of the example rotatable tubing anchor in FIG. 1 as it is mounted in a production tubing string and shown with the mandrel locked against rotation in relation to the drag body and other anchor assembly components as they would be as the production tubing string, rotatable tubing anchor, and pump are lowered into a well.
Figure 9:
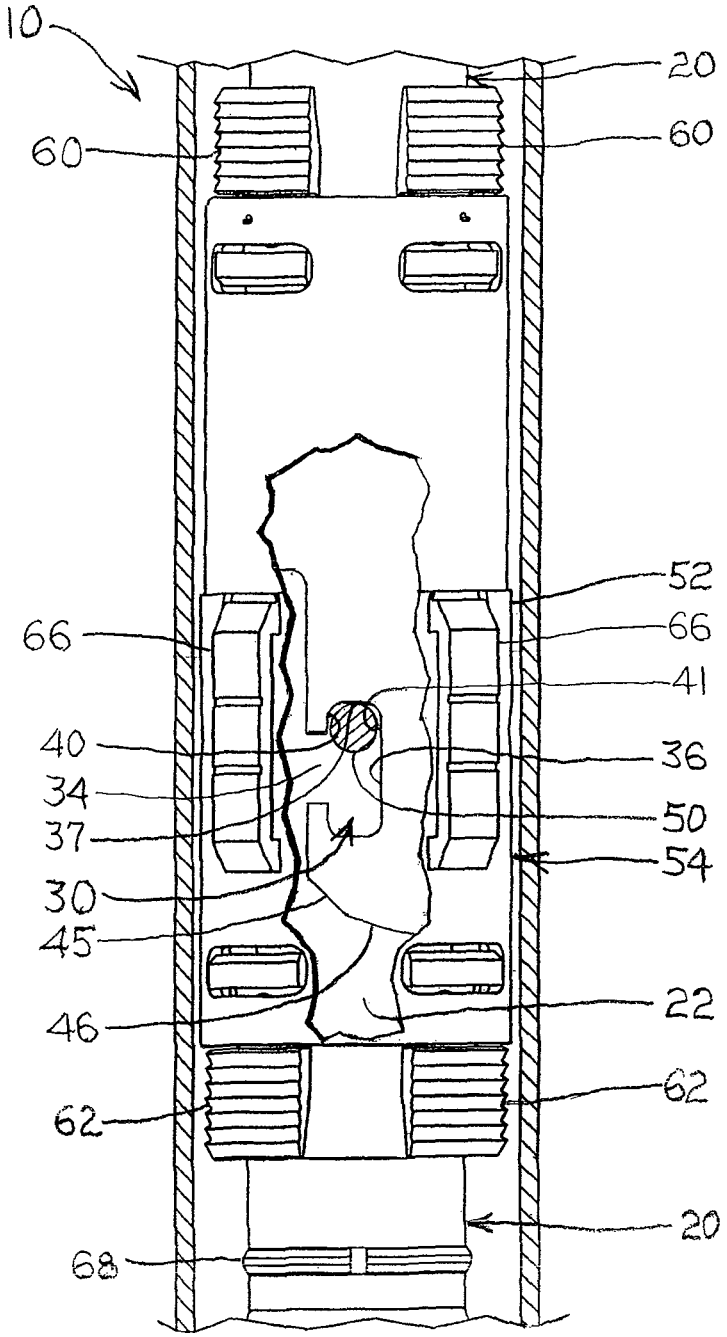
FIG. 9 is an enlarged view of the portion of the elevation view of FIG. 8 that is circled in FIG. 8.

For lowering the tubing string T, rotatable tubing anchor 10, and pump P into the well, the relative positions of the mandrel 20, including the lock slot 30, in relation to the drag body 52, including the lock pin 50, and in relation to the slips 60, 62 are best seen in FIGS. 8 and 9, keeping in mind the configuration of the lock slot 30 best seen in FIG. 2 and the radially inner end 51 of the lock pin 50 best seen in FIGS. 5 and 6. In FIGS. 8 and 9, the example rotatable tubing anchor 10 is illustrated diagrammatically with a portion of cylindrical drag body 52 surrounding the lock pin 50 cut away to reveal the relevant portions of the lock slot 30 in the mandrel 30 in relation to the lock pin 50. The lock pin 50 in FIGS. 8 and 9 is shown with cross-hatching as the hexagonal head and radially outer portions of lock pin 50 are cut away along with the surrounding portion of the drag body 52, thus leaving the radially inner portion of the lock pin 50 in its proper position in relation to the rest of the drag body 52 that is still visible in the view of FIGS. 8 and 9. In this manner, the manipulations and relative positions of the mandrel 20 with its lock slot 30 in relation to the drag body 52 with its lock pin 50 can be visualized along with this description.

The mandrel 20 is of such a length, and the upper and lower cones 25, 27 are at such a distance apart from each other, that when the mandrel 20 is positioned in the cylindrical drag body 52 in such a manner that the lock pin 50 extends into any position in the lazy T portion 34 of the lock slot 30, neither one of the upper and lower cones 25, 27, respectively, are wedged into the respective upper and lower wedge assemblies 56, 58. Therefore, positioning the mandrel 20 in the cylindrical drag body 52 where the lock pin 50 extends into the lazy T slot portion 34 of the lock slot 30 keeps both the upper slip assembly 56 and the lower slip assembly 58 disengaged from the casing C, as illustrated, for example, in FIGS. 8 and 9. With both the upper slips 60 and the lower slips 62 disengaged from the casing C, the production tubing string T with the rotatable tubing anchor 10 and down hole pump P can be lowered into, or pulled out of, the well.

Drag pads 66 are mounted in the drag body 52 with a spring bias that forces the drag pads 66 radially outward from the drag body 52 into frictional engagement with the inside surface of the casing C in a manner known and understood by persons skilled in the art. The friction between the drag pads 66 and the casing C resists any longitudinal or rotational movement of the drag body 52 in relation to the casing C. Therefore, in order to move the drag body 52 up, down, clockwise, or counterclockwise in the casing C, enough force has to be applied to the drag body 52 by the tubing string T via the mandrel 20 and lock pin 50 to overcome the friction. Any convenient number of drag pads 66 can be used. The example rotatable tubing anchor 10 is shown with four drag pads 66.

As explained above, when the mandrel 20 is positioned in relation to the drag body 52 in such a manner that the lock pin 50 is anywhere in the lazy T portion 34 of the lock slot 30, none of the slips 60, 62 are set, so the only significant resistance to movement of the rotatable tubing anchor 10 upwardly or downwardly in the casing C is the friction between the drag pads 66 and the casing wall C. For lowering the tubing string T with the rotatable tubing anchor 10 and pump P into the well, the mandrel 20 is manipulated in relation to the drag body 52 in such a manner as to get the cross-bar 36 of the lazy T portion 34 of the lock slot 30 aligned with the lock pin 50. Then, as the tubing string T, rotatable tubing anchor 10, and pump P are lowered into the well, the friction between the drag pads 66 and the inside surface of the casing C resists the downward movement of the drag body 52 in the casing C, which causes the mandrel 20 to move longitudinally downward in relation to the drag body 52 until the upper edge 37 of the lazy T portion 34 of the lock slot 30 contacts and bears against the lock pin 50 as illustrated in FIGS. 8 and 9. The weight or lowering force of the tubing string T applied on the mandrel 20 is then transferred via the lock pin 50 to the drag body 52 to overcome the friction between the drag pads 66 and the casing C and thereby push the rotatable anchor body 10 down the well in spite of the drag pads 66 dragging on the inside surface of the casing C. The position of the lock pin 50 illustrated in FIGS. 8 and 9 against the upper edge 37 and also confined laterally by the adjacent lateral edges 40, 41 of the lazy T cross-bar 36 (see FIG. 9) prevent the mandrel 20 from rotating in relation to the drag body 52 so that the lock pin 50 cannot escape from the lazy T portion 34 of lock slot 30 as the rotatable tubing anchor 10 with the pump P are being pushed down the well by the production tubing string T.

Generally, the rotatable tubing anchor 10 with the pump P are pushed by the production tubing string T downwardly in the well casing C to a desired position where the pump P is immersed in the fluid F in the casing C as illustrated, for example, in FIG. 7. At the desired depth, the lower slips 62 are set against the inside surface of the casing C to anchor the production tubing string T at or near its lower end to the casing C in a manner that provides a strong resistance to an upward force. Therefore, when a strong upward force is pulled on the production tubing string T from the well head (not shown) at the surface of the ground, the anchored rotatable tubing anchor 10 strongly resists such upward force and prevents the portion of the string T that is attached to the mandrel 20 from moving in relation to the casing C. Consequently, when the lower slips 62 are set to anchor the rotatable tubing anchor 10 to the desired position in the casing C, an upward force pulled on the tubing string T from the surface of the ground will place the tubing string T in tension and thereby keep the lower slips 62 set by preventing lowering of the mandrel 20 and disengagement of the lower cone 27 from wedging the lower slips 62 into the casing C. As also explained above, applying such an upward force on the tubing string T at the well head at the surface of the ground to place the tubing string T intension also tends to keep the tubing string T as straight as possible and to minimize lateral movement of sections of the tubing string T in response to pumping fluid pressure pulses and mechanical forces and thereby minimizes wear from the reciprocal movement of the sucker rod R in the tubing string T. In order to set the lower slips 62 to anchor the rotatable tubing anchor 10 to the casing, the mandrel 20 has to be manipulated to disengage the lock pin 50 from the lazy T portion 54 of the lock slot 30 so that the mandrel 20 can be pulled upwardly in relation to the drag body 52 far enough to engage and wedge the lower cone 27 against the lower slips 62, as best seen in FIGS. 10 and 11.

As explained above and shown in FIGS. 8 and 9, for lowering the production tubing string T with the rotatable tubing anchor 10 and pump P down the casing C, the mandrel 20 is positioned in relation to the drag body 52 in such a manner that downward movement of the mandrel 20 in relation to the drag body 52 is prohibited by the upper edge 37 bearing on the lock pin 50, and rotation of the mandrel 20 in relation to the drag body 52 is prohibited by the upper lateral edges 40, 41 on either side of the lock pin 50. Further, the length of the cross-bar 36 of the lazy T portion 34 of the lock slot 30 does not allow enough upward movement of the mandrel in relation to the drag body 52 to set the lower slips 62 to anchor the rotatable tubing anchor 10 against the upward tension required for the tubing string T. Therefore, in order to set the slips 62 against the casing C to anchor the production tubing string T, the mandrel 20 has to be manipulated in relation to the drag body 52 in a manner that is effective to disengage the mandrel 20 from the drag body 52 and lock pin 50, as best explained with reference to FIGS. 10 and 11, keeping in mind the configuration of the lock slot 30 as best seen in FIG. 2. For this explanation, it is also helpful to keep in mind that the drag pads 66 on the drag body 52 pressing by spring force against the casing C create enough friction to keep the drag body 52 with the lock pin 50 as well as the slips 60, 62 and other components of the anchor assembly 54 stationary in relation to the casing C while the mandrel 20 moves up and down and rotates, as long as the mandrel 20 does not engage the lock pin 50. Therefore, as long as the mandrel 20 does not engage the lock pin 50, the mandrel 20 with its lock slot 30 can be moved up, down, and rotationally by manipulating the production tubing string T up, down, and rotationally while the drag body 52, lock pin 50, and slips 60, 62 of the anchor assembly 54 remain stationary. The goal of the maneuver required to set the lower slips 62 is to get the mandrel 20 with its lock slot 30 disengaged from the lock pin 50 so that the mandrel 20 can be pulled upwardly by the tubing string T enough to wedge the lower cone 27 into the lower slips 62. Also, the mandrel 20 has a circumferential groove 22 extending round its peripheral surface with a connection to the lock slot 30 (see FIG. 2) at the entrance portion 32 of the lock slot 30. The spacing of the circumferential groove 22 in relation to the lower cone 27 is such that the circumferential groove 22 aligns with the lock pin 50 when the mandrel 20 is positioned with the lower cone 27 wedged into the lower slips 62, as illustrated in FIGS. 10 and 11. Consequently, the mandrel 20 rotatable, 360 degrees and more in relation to the stationary drag body 52 without constraint by or engagement with the lock pin 50 when the mandrel 20 is in the longitudinal position to engage and set the lower slips 62. Therefore, the mandrel 20 can rotate freely about the longitudinal axis 12 in relation to the drag body 52 and lock pin 50 when the lower slips 62 are set to anchor the rotatable tubing anchor 10 and lower end of the tubing string T to the casing C.

To maneuver the mandrel 20 from the position for lowering the tubing string T, the rotatable tubing anchor 10, and the pump P into the well, as shown in FIGS. 8 and 9, to the anchor position shown in FIGS. 10 and 11, the mandrel 20 has to be pulled upwardly by the production tubing string T enough to move the upper edge 37 of the lazy T portion 34 of the lock slot 30 upwardly and away from the stationary lock pin 50, and then the mandrel 20 has to be rotated by the tubing string T to the right (i.e., counterclockwise 16 as shown in FIG. 2) in order to move the vertical entrance portion 32 of the lock slot 30 to the right into alignment with the stationary lock pin 50. Then, with the vertical entrance portion 32 of the lock slot 30 aligned with the stationary lock pin 50, the mandrel 20 has to be pulled by the tubing string T upwardly again to wedge the lower cone 27 into the lower slips 62 hard enough to force the lower slips 62 radially outward into anchored engagement with the inside surface of the casing C, as shown in FIGS. 10 and 11.

As mentioned above, when the mandrel 20 is positioned for the lower cone 27 to set the lower slips 62 into anchoring engagement with the casing C as shown in FIGS. 10 and 11, the circumferential groove 22 in the mandrel 20 aligns with the stationary lock pin 50, which enables the mandrel 20 to rotate freely 360 degrees in relation to the lock pin 50, drag body 52, slips 62, and other components of the anchor assembly 54. Such capability of the mandrel 20 to rotate 360 degrees (and continuously more than 360 degrees during production operations) in relation to the anchor assembly 54 is necessary to accommodate the rotational movement of the tubing string T during production operations, as explained above. However, to further enable and accommodate such free rotation of the mandrel 20 in relation to the drag body 52 and other components of the anchor assembly 54, the lower cone 27 is mounted in a rotatable manner on the mandrel 20 with a thrust bearing 70 (best seen in FIG. 5) between the lower cone body 27 and a shoulder or ring 72, which is part of, or attached to, the mandrel 20. Therefore, the upward force applied by the mandrel 20 to the lower cone 27 is born by the thrust bearing 70 in a near frictionless manner that allows the mandrel 20 to rotate in relation to the lower cone 27 as the lower cone 27 is wedged tightly against the lower slips 62 and remains stationary in relation to the lower slips 62 and other components of the anchor assembly 54.

Figure 12:
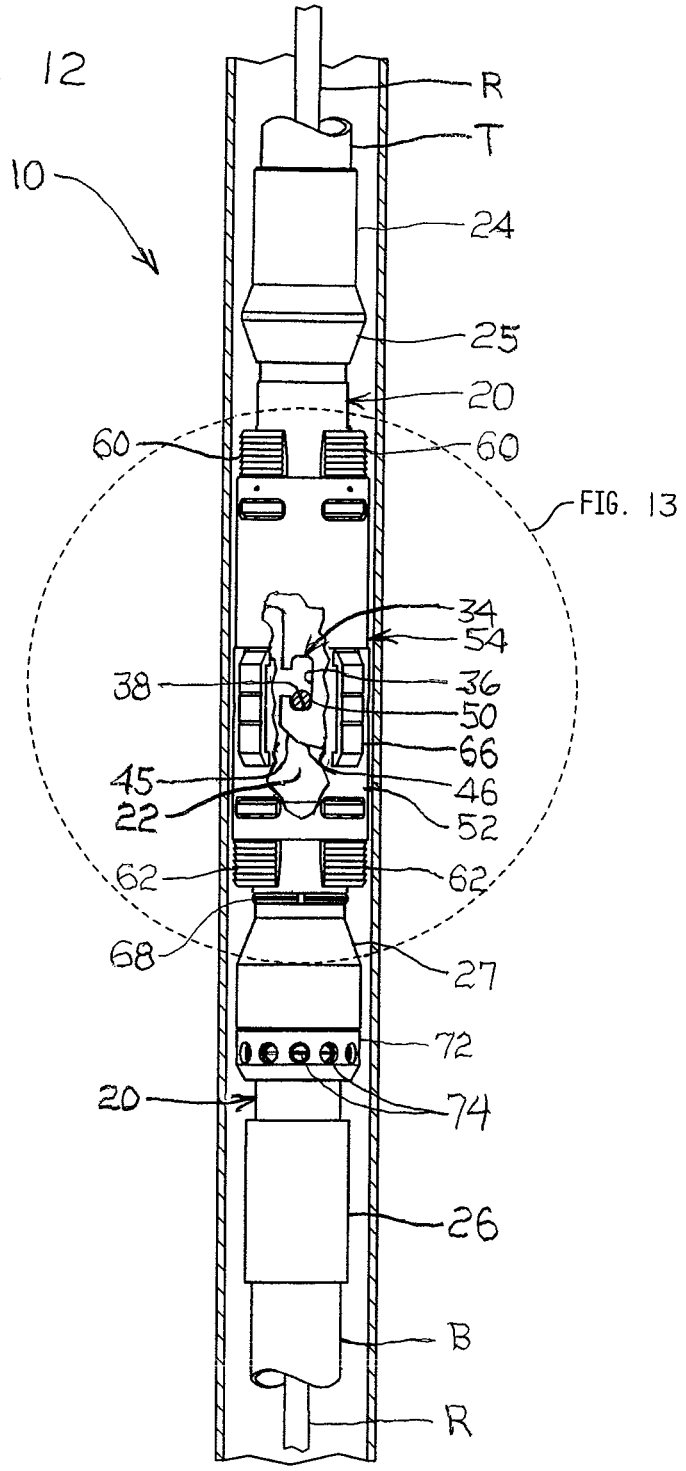
FIG. 12 is an elevation view of the example rotatable tubing anchor similar to FIGS. 8 and 10, but with the mandrel locked against rotation in relation to the drag body and other anchor assembly components as they would be as the production tubing string, rotatable tubing anchor, and pump are being pulled out of the well.
Figure 13:
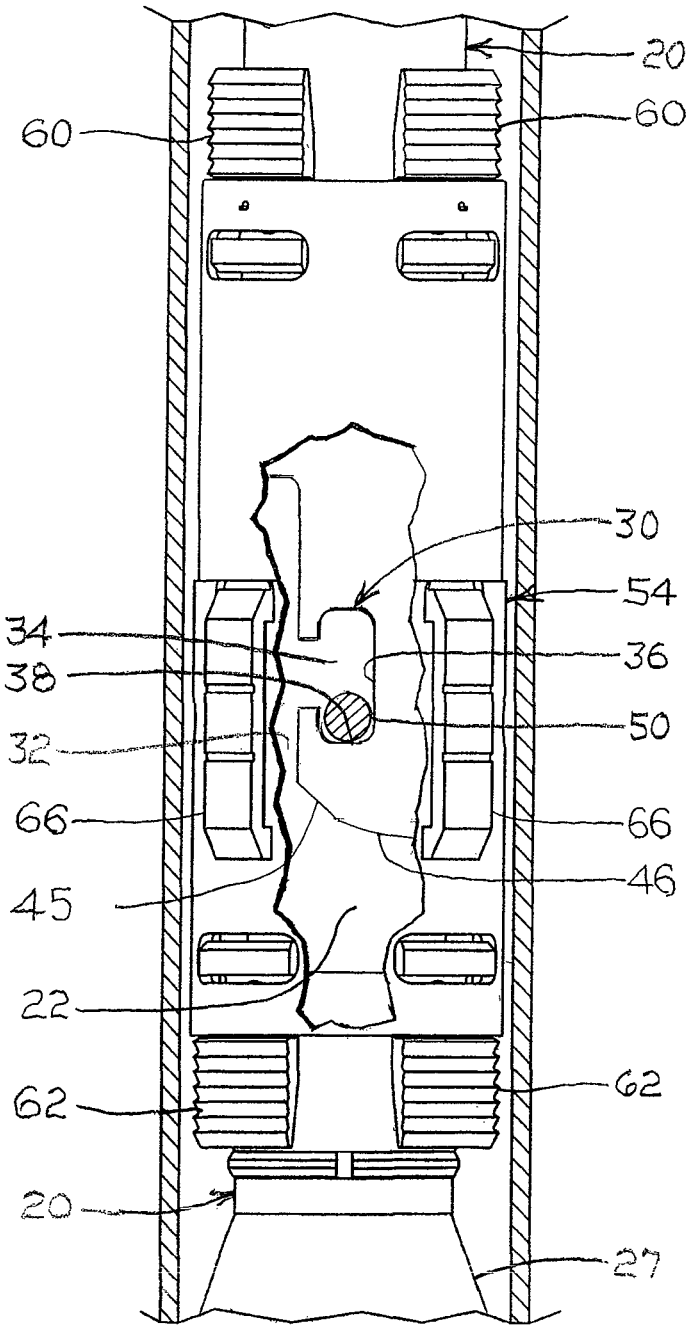
FIG. 13 is an enlarged view of the portion of the elevation view of FIG. 12 that is circled in FIG. 12.

For pulling the example rotatable tubing anchor 10 and pump P out of the well, the mandrel 20 has to be maneuvered to release the lower slips 62 from casing C and then positioned as shown in FIGS. 12 and 13 in which the lower edge 38 of the lazy T cross-bar 36 abuts the lock pin 50. With the lower slips 62 released and the mandrel 20 in that position, an upward force applied by the tubing string T to the mandrel 20 can pull the rotatable tubing anchor 10 along with the pump P out of the well. The upward force on the mandrel 20 is transferred by the lower edge 38 of the lazy T portion 34 of the lock slot 30 to the lock pin 50 and thereby to the drag body 52. When sufficient upward force is applied to the mandrel 20 and drag body 52 to overcome the friction between the drag pads 66 and the casing C, the rotatable tubing anchor 10 and the pump P can be pulled upwardly through the casing C to the surface of the ground G.

To release the lower slips 62 and move the mandrel 20 from the anchored position shown in FIGS. 10 and 11 to the pull-out position shown in FIGS. 12 and 13, the tubing string T is used to apply a downward force on the mandrel 20 to push the lower cone 27 away from the lower slips 62, thereby releasing the lower slips 62 from the casing C. The tubing string T is also rotated to rotate the mandrel 20 to align the entrance portion 32 of the lock slot 30 with the stationary lock pin 50, and then lowered farther to move the entrance portion 32 downward and around the lock pin 50 until the stem 35 of the lazy T portion 34 of the lock slot 30 aligns with the lock pin 50. The approaches to the entrance portion 32 of the lock slot 30 from the circumferential groove 22 can be tapered, as illustrated for example at the diagonal edges 44, 45 at the intersection of the circumferential groove 22 with the entrance portion 32, to facilitate aligning the entrance portion 32 with the lock pin 50 and capturing the lock pin 50 into the lock slot 30. With the stem 35 aligned with the lock pin 50, the tubing string T is then used to rotate the mandrel 20 to the left (i.e., clockwise 17 as shown in FIG. 2) until the cross-bar 36 of the lazy T portion 54 of the lock slot 30 aligns with the lock pin 50. Finally, with the cross-bar 36 aligned with the lock pin 50, the tubing string T can be pulled upwardly, which pulls the mandrel 20 upwardly in relation to the lock pin 50 and drag body 52 until the bottom edge 38 of the lazy T portion 34 of the lock slot 30 abuts the lock pin 50, at which point the upward force applied on the mandrel 20 by the tubing string T is transferred to the drag body 52 via the lock pin 50, and the entire assembly of the tubing string T, rotatable tubing anchor 10, and pump P can be pulled out of the well.

In the example rotatable tubing anchor 10 shown in FIG. 5, the ring 72 is a shear ring, which is attached to the mandrel 20 with a plurality of shear pins 74. The shear pins 74 extend through the shear ring 72 and into the groove 76 in the mandrel 20 (FIGS. 2 and 5). While this shear ring 72 feature is not essential, it does provide an alternate way of releasing the lower slips 62, if necessary, in the event an operator is unable to release the lower slips 62 by the manipulations described above. A large enough upward force pulled by the tubing string T on the mandrel 20 with the lower slips 62 still set and anchored to the casing C will shear the shear pins 74, thereby releasing the mandrel 20 from the shear ring 72 and from the lower cone 27. With the shear pins 74 sheared and the shear ring 72 free to slide on the mandrel 20, the lower cone 27 can drop by gravity away from the lower slips 62 and thereby release the lower slips 62 from the casing C to disengage the rotatable anchor device 10 from the casing C. The tubing string T, rotatable anchor device 10, and pump P can then be pulled out of the well.

In some circumstances, an operator may find that one or more sections of tubing in the tubing string T are so badly worn or otherwise deteriorated that the tubing string T breaks between the surface of the ground and the rotatable tubing anchor 10 so that the remaining portion of the tubing string T under the break is no longer in tension. Instead, the weight of that remaining portion of the tubing string T under the break pushes the mandrel 20 with the lower cone 27 down in relation to the drag body 52 and releases the lower slips 62 from the casing C. In that situation, the entire rotatable tubing anchor 10, the remaining portion of the tubing string T under the break, and the pump P would fall to the bottom of the well. The upper slips 60 and upper cone 25 are optional, but they can be provided to prevent or arrest such a fall, as illustrated in FIGS. 14 and 15. If the tubing string T breaks as described above, the weight of the remaining portion of the tubing string T under the break pushes the mandrel 20 downward enough in relation to the drag body 52 and slip cage 64 to force the upper cone 25 to wedge against the upper slips 60, as illustrated in FIGS. 14 and 15, and thereby drive the upper slips 60 radially outward into anchoring engagement with the inside surface of the casing C. Such engagement of the upper slips 60 with the casing C prevents the rotatable tubing anchor 10, tubing string T, and pump P from falling farther down the well, which makes it easier to recover them from the well with conventional "fishing" tools and techniques.

In order for the mandrel 20 to move downward in relation to the drag body 52 enough to set the upper slips 60, the downward motion of the mandrel 20 in relation to the drag body 52 has to be able to capture the lock pin 50 in the upper extremity 33 of the entrance portion 32 as shown in FIGS. 14 and 15. Therefore, the mandrel 20 has to be rotated to position in relation to the drag body 52 in which the entrance portion 32 aligns with the lock pin 50. Since the tubing string T in the circumstance described is broken between ground and the rotatable tubing anchor 10 as explained above, the mandrel 20 cannot be rotated by manipulation of the tubing string T. To mitigate this problem, the mandrel 20 can be made self-aligning by providing the circumferential groove 22 with an upper edge 46 that curves or slants upwardly toward the entrance portion 32 of the lock slot 30 to act as a cam surface to cam the mandrel 20 into such alignment. The upper edge 46 can be curved to provide such a slant as shown, for example, in FIGS. 2, 8, 12, and 13, or the slant can be provided by a straight upper edge slanted toward the entrance portion 32. If two lock slots 30 are used as mentioned above, the upper edge 46 can be slanted toward the respective entrance portions 32 of both lock slots 30. Therefore, with the weight of the tubing string T pushing down on the mandrel 20 and the upper edge 46 bearing on the lock pin 50, the upper edge 46 cams the mandrel 20 to rotate until the entrance portion 32 moves into alignment with the lock pin 50, whereupon the mandrel 20 drops farther to set the upper slips 60 as described above. With the upper slips 60 set in that manner, the rotatable tubing anchor 10 will remain anchored to the casing C as long as the upper cone 25 is wedged against the upper slips 60. Then, if the portion of the broken tubing string T that is still connected to the mandrel 20 is captured, for example, with a "fishing tool", then an upward pull on that portion of the tubing string or on the coupler 24 will pull the upper cone 25 away from the upper slips 60, thereby releasing the rotatable tubing anchor 10 to be pulled out of the well with the pump P.

Although the description above is provided with reference to oil wells, this invention is applicable to any type of well in which reciprocating piston pumps are used to pump a fluid through a production tubing string, including, but not limited to water wells. Also, while the lazy T portion 34 of the lock slot 30 in the mandrel 20 is shown and described as extending to the right of the entrance portion 32, the lazy T portion 34 could extend to the left of the entrance port 32 as would be understood by person skilled in the art once they understand the principles of the operations and functions described above. The drag body 52 and slip cage 64 are shown and described as two components, although they could be one component or any other structure that provides the functions described above.

The foregoing description provides examples that illustrate the principles of the invention, which is defined by the claims that follow. Since numerous insignificant modifications and changes will readily occur to those skilled in the art once they understand the invention, it is not desired to limit the invention to the exact example constructions and processes shown and described above. Accordingly, resort may be made to all suitable combinations, subcombinations, modifications, uses, and equivalents that fall within the scope of the invention as defined by the claims. The words "comprise," "comprises," "comprising," "composed," "composes," "composing," "include," "including," and "includes" when used in this specification, including the claims, are intended to specify the presence of stated features, integers, components, or steps, but they do not preclude the presence or addition of one or more other features, integers, components, steps, or groups thereof.

The invention and several embodiments in which an exclusive property or privilege is claimed are defined as follows:

1. Rotatable tubing anchor apparatus for anchoring a tubing string to an inside surface of a casing in a well, comprising:

an anchor assembly that includes a cylindrical drag body, a plurality of drag pads that are spring biased to extend radially outward from the cylindrical drag body far enough to contact and drag against the inside surface of the casing, a lock pin that extends inwardly from the drag body, and slips that are extendable radially outward and adapted for securely anchoring the drag body to the inside surface of the casing in a settable and releasable manner; and a mandrel that is positioned in and extends through the cylindrical drag body in a manner that is vertically slidable and rotatable in relation to the drag body, said mandrel comprising a conical wedge positioned to engage with and wedge the slips radially outward in relation to the cylindrical drag body by upward movement of the mandrel in relation to the cylindrical drag body and slips and to disengage with the slips to release the slips from engagement with the casing by downward movement of the mandrel in relation to the cylindrical drag body and slips, and said mandrel also having a circumferential groove extending around the periphery of the mandrel and a lock slot connected with the circumferential groove, and the lock slot has an entrance portion connected with and extending upwardly from the circumferential groove and a lazy T portion extending laterally from the entrance portion, and further wherein the circumferential groove and the lock slot are at a depth and sized to receive the inner end of the lock pin in a slidable manner such that vertical and rotational movement of the mandrel in relation to the drag body is limited by the lock pin in the lock slot and in the circumferential groove.

2. The rotatable tubing anchor apparatus of claim 1, wherein the spatial relationship of the lazy T portion of the lock slot and the conical wedge on the mandrel to each other and the spatial relationship of the lock pin and the slips to each other are such that the conical wedge cannot set the slips when the mandrel is positioned in the cylindrical drag body with the lock pin extending into the lazy T portion of the lock slot.

3. The rotatable tubing anchor apparatus of claim 2, wherein the spatial relationship of the circumferential groove and the conical wedge on the mandrel to each other and the spatial relationship of the lock pin and the slips to each other are such that the lock pin extends into the circumferential groove in the mandrel so that the mandrel is rotatable in relation to the cylindrical drag body when the conical wedge is positioned to set the slips into anchoring engagement with the casing.

4. The rotatable tubing anchor apparatus of claim 3, wherein the circumferential groove has an upper edge that slants toward the entrance portion of the lock slot.

5. The rotatable tubing apparatus of claim 4, wherein the anchor assembly includes a second set of slips that are extendable radially outward and adapted for securely anchoring the drag body to the inside surface of the casing in a settable manner by downward movement of the mandrel in relation to the drag body, and wherein the entrance portion of the lock slot includes an extremity that accommodates sufficient downward movement of the mandrel in relation to the lock pin to set the upper slips.

6. A method of controlling anchoring a tubing string to a casing in a well, comprising:

attaching a mandrel of a rotatable tubing anchor to the tubing string, wherein the rotatable tubing anchor includes a cylindrical drag body, a plurality of drag pads that are spring biased to extend radially outward from the cylindrical drag body far enough to contact and drag against the inside surface of the casing, a lock pin that extends inwardly from the drag body, and slips that are extendable radially outward and adapted for securely anchoring the drag body to the inside surface of the casing in a settable and releasable manner, the mandrel being positioned in and extending through the cylindrical drag body in a manner that is vertically slidable and rotatable in relation to the drag body, said mandrel comprising a conical wedge, a circumferential groove extending around the periphery of the mandrel, and a lock slot with an entrance portion connected with and extending upwardly from the circumferential groove and a lazy T portion with a stem of the lazy T portion extending laterally from the entrance portion to a cross-bar of the lazy T portion;

positioning the mandrel in the drag body in such a manner that the lock pin extends into the lazy T portion cross-bar of the lock slot;

lowering the tubing string with the rotatable tubing anchor into the casing to a desired position in the casing;

manipulating the tubing string to pull the mandrel upwardly in relation to the drag body and lock pin until the stem of the lazy T portion aligns with the lock pin and then to rotate the mandrel until the entrance portion aligns with the lock pin and then to pull the mandrel upwardly far enough to wedge the conical wedge into to the slips to set the slips in anchoring engagement with the casing.

* * * * *